US008246413B2

(12) United States Patent
Liu et al.

(10) Patent No.: US 8,246,413 B2
(45) Date of Patent: Aug. 21, 2012

(54) METHOD FOR MAKING FIELD EMISSION DEVICE

(75) Inventors: Peng Liu, Beijing (CN); Duan-Liang Zhou, Beijing (CN); Pi-Jin Chen, Beijing (CN); Zhao-Fu Hu, Beijing (CN); Cai-Lin Guo, Beijing (CN); Bing-Chu Du, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 27 days.

(21) Appl. No.: 12/959,605

(22) Filed: Dec. 3, 2010

(65) Prior Publication Data

US 2011/0287684 A1 Nov. 24, 2011

(30) Foreign Application Priority Data

May 20, 2010 (CN) ..... 2010 1 0178171

(51) Int. Cl.
*H01J 1/00* (2006.01)

(52) U.S. Cl. ..... 445/35; 313/498; 445/50; 445/51

(58) Field of Classification Search ..... 313/495–497, 313/309–310; 445/23
See application file for complete search history.

(56) References Cited

U.S. PATENT DOCUMENTS

| | | | | |
|---|---|---|---|---|
| 2005/0184643 | A1* | 8/2005 | Cho et al. | 313/495 |
| 2005/0189860 | A1* | 9/2005 | Nam et al. | 313/311 |
| 2007/0051965 | A1* | 3/2007 | Du et al. | 257/98 |
| 2008/0187093 | A1* | 8/2008 | Price et al. | 378/19 |
| 2008/0233763 | A1* | 9/2008 | Kim et al. | 438/775 |
| 2009/0124160 | A1* | 5/2009 | Xu | 445/51 |
| 2009/0325329 | A1* | 12/2009 | Kuribayashi | 438/20 |
| 2010/0285715 | A1* | 11/2010 | Li et al. | 445/50 |

* cited by examiner

*Primary Examiner* — Tracie Y Green
(74) *Attorney, Agent, or Firm* — Altis Law Group, Inc.

(57) ABSTRACT

A method for making a field emission device includes the following steps. An insulative substrate is provided. An electron pulling electrode is formed on the insulative substrate. A secondary electron emission layer is formed on the electron pulling electrode. A first dielectric layer is fabricated. The first dielectric layer has a second opening to expose the secondary electron emission layer. A cathode plate having an electron output portion is provided. An electron emission layer is formed on part surface of the cathode plate. The cathode plate is placed on the first dielectric layer. The electron output portion and the second opening have at least one part overlapped, and at least one part of the electron emission layer is oriented to the secondary electron emission layer via the second opening.

13 Claims, 11 Drawing Sheets

METHOD FOR MAKING FIELD EMISSION DEVICE

RELATED APPLICATIONS

This application claims all benefits accruing under 35 U.S.C. §119 from China Patent Application No. 201010178171.5, filed on May 20, 2010 in the China Intellectual Property Office, the contents of which are hereby incorporated by reference. This application is related to applications entitled, "FIELD EMISSION DEVICE", filed on Dec. 3, 2010 with U.S. patent application Ser. No. 12/959,592; and "ION SOURCE", filed on Dec. 3, 2010 with U.S. patent application Ser. No. 12/959,601.

BACKGROUND

1. Technical Field

The present disclosure relates to a field emission device, a method for making the same, and an ion source using the same.

2. Description of Related Art

Field emission displays (FEDs) are a new, rapidly developing flat panel display technology.

Field emission devices are important elements in FEDs. A field emission device usually includes an insulating substrate, a cathode electrode located on the insulating substrate, a dielectric layer located on the cathode electrode defining a number of holes to expose the cathode electrode, a number of carbon nanotubes located on the exposed cathode electrode, and an anode electrode spaced from the cathode electrode. When a voltage is applied between the anode electrode and the cathode electrode, a number of electrons are emitted from the carbon nanotubes and strike the anode electrode through the holes. However, the electrons collide with free gas molecules in the vacuum and ionize the free gas molecules, thereby producing ions. The ions move toward the cathode electrode and bombard the carbon nanotubes exposed through the holes. The carbon nanotubes become damaged, thus causing the field emission device to have a short lifespan.

What is needed, therefore, is a method for making a field emission device that can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission device, method for making the same, and ion source using the same. The field emission device can include a single unit or a number of units to form an array. In following embodiments, only a single unit is provided and described as example.

Figure 1:
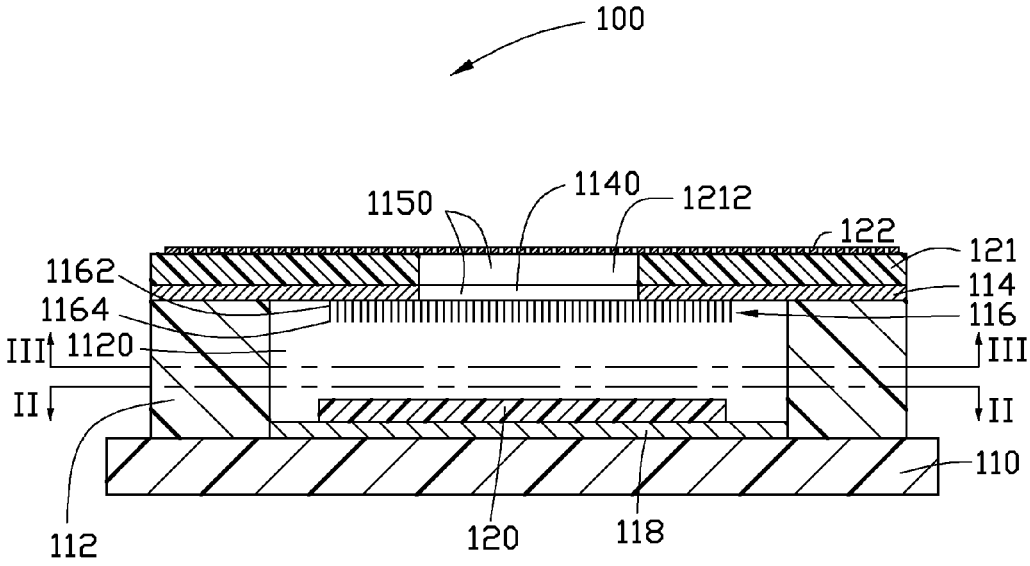
FIG. 1 is a schematic view of one embodiment of a field emission device.
Figure 2:
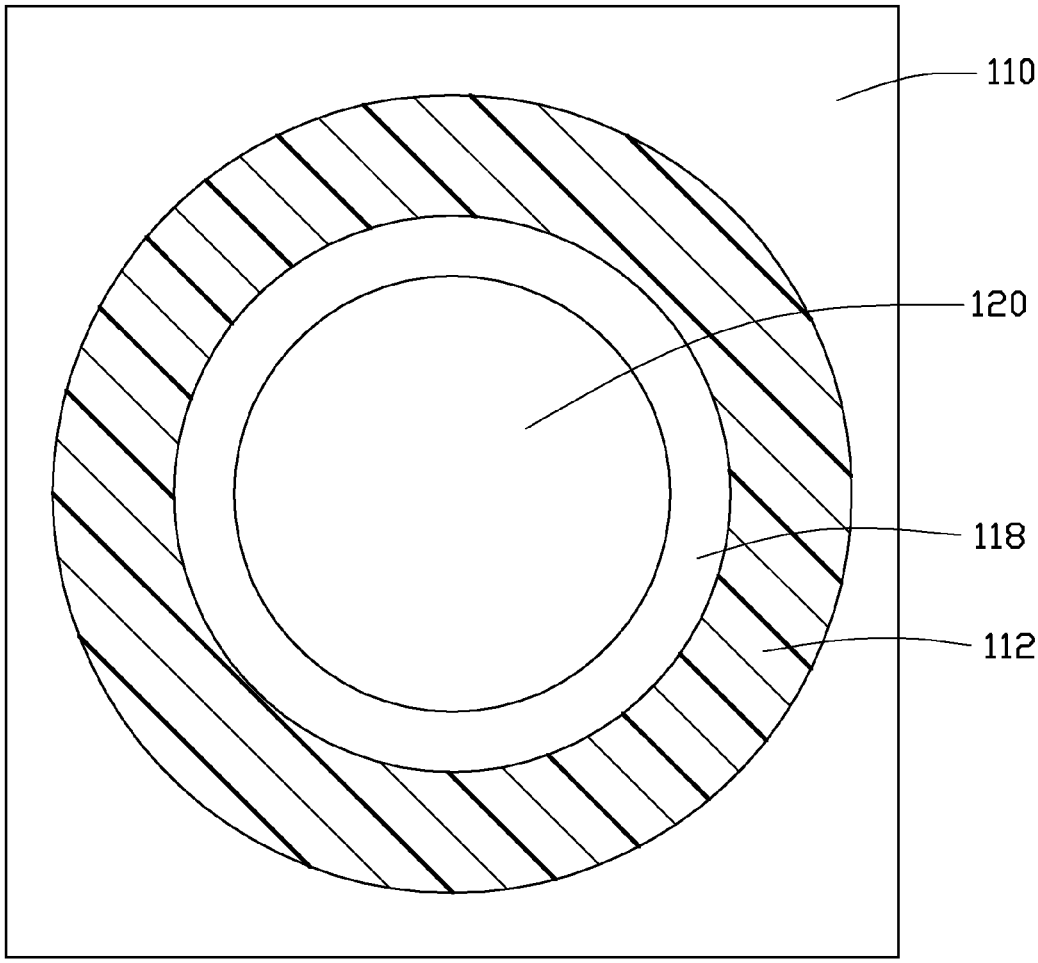
FIG. 2 is a schematic, cross-sectional view, along a line II-II of FIG. 1.
Figure 3:
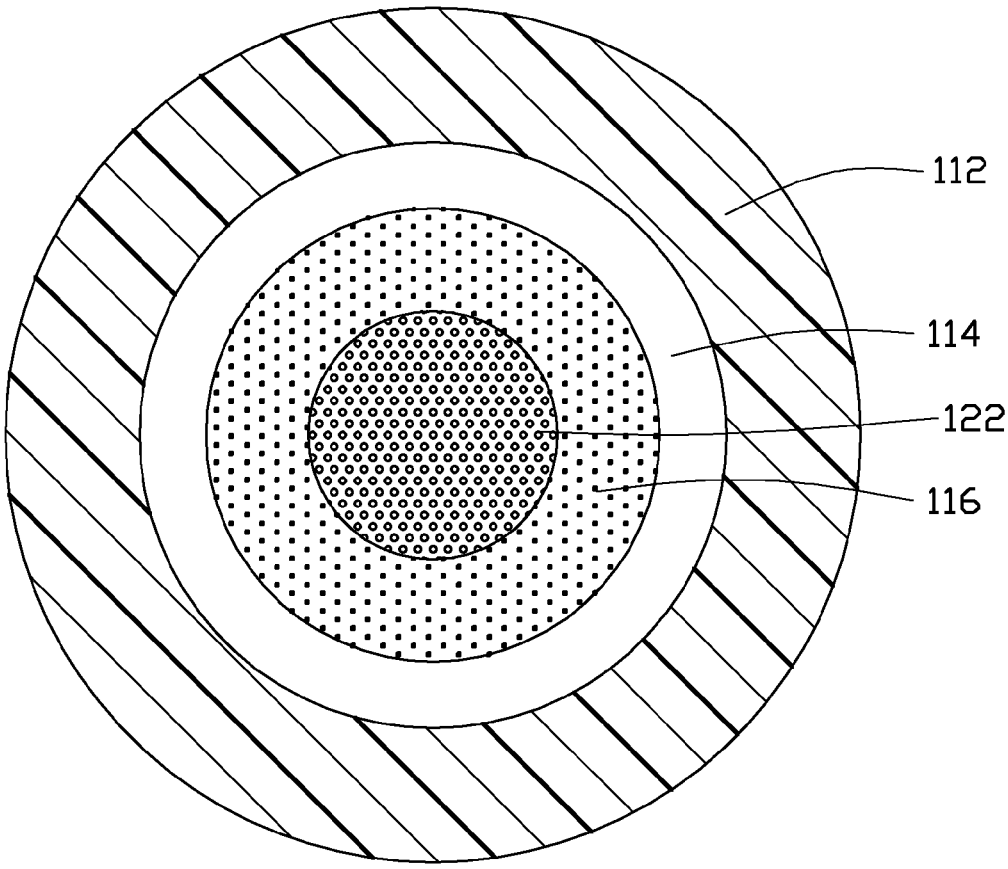
FIG. 3 is a schematic, cross-sectional view, along a line III-III of FIG. 1.

Referring to FIGS. 1 to 3, a field emission device 100 of one embodiment includes an insulative substrate 110, a first dielectric layer 112, a cathode electrode 114, an electron emission layer 116, an electron pulling electrode 118, a secondary electron emission layer 120, a second dielectric layer 121, and a gate electrode 122.

The insulative substrate 110 has a top surface. The electron pulling electrode 118 is located on the top surface of the insulative substrate 110. The secondary electron emission layer 120 is located on a top surface of the electron pulling electrode 118. The cathode electrode 114 is located apart from the electron pulling electrode 118 by the first dielectric layer 112. The electron pulling electrode 118 is located between the cathode electrode 114 and the insulative substrate 110. The cathode electrode 114 defines a first opening 1140. At least a part of the first opening 1140 is oriented to the electron pulling electrode 118. The cathode electrode 114 has a bottom surface oriented to the electron pulling electrode 118. The electron emission layer 116 is located on the bottom surface of the cathode electrode 114. The gate electrode 122 is located apart from the cathode electrode 114 by the second dielectric layer 121. The cathode electrode 114 is located between the gate electrode 122 and the electron pulling electrode 118. The electron emission layer 116 can emit electrons to bombard the secondary electron emission layer 120 to produce secondary electrons. The secondary electrons can exit through the first opening 1140 under the electric field force of the gate electrode 122.

The insulative substrate 110 can be made of insulative material. The insulative material can be ceramics, glass, resins, quartz, or polymer. The size, shape, and thickness of the insulative substrate 110 can be chosen according to need. The insulative substrate 110 can be a square plate, a round plate or a rectangular plate. In one embodiment, the insulative substrate 110 is a square glass plate with a thickness of about 1 millimeter and an edge length of about 10 millimeters.

The electron pulling electrode 118 is a conductive layer. The size, shape and thickness of the electron pulling electrode 118 can be chosen according to need. The electron pulling electrode 118 can be made of metal, alloy, conductive slurry, or indium tin oxide (ITO). The metal can be copper, aluminum, gold, silver, or iron. The conductive slurry can include metal powder from about 50% to about 90% (by weight), glass powder from about 2% to about 10% (by weight), and binder from about 8% to about 40% (by weight). If the insulative substrate 110 is silicon, the electron pulling electrode 118 can be a doped layer. In one embodiment, the electron pulling electrode 118 is a round aluminum film with a thickness of about 20 micrometers.

The secondary electron emission layer 120 can be made of magnesium oxide (MgO), beryllium oxide (BeO), magnesium fluoride ($MgF_2$), beryllium fluoride ($BeF_2$), cesium oxide (CsO), barium oxide (BaO), silver oxygen cesium (Ag—O—Cs), antimony-cesium alloy, silver-magnesium alloy, nickel-beryllium alloy, copper-beryllium alloy, aluminum-magnesium alloy, or GaP(Cs). The size, shape, and thickness of the secondary electron emission layer 120 can be chosen according to need. The secondary electron emission layer 120 can have a curved surface or a concave-convex structure on a top surface oriented to the electron emission layer 116. In one embodiment, the secondary electron emission layer 120 is a round BaO film with a thickness of about 20 micrometers.

The cathode electrode 114 can be a conductive layer or a conductive plate. The size, shape, and thickness of the cathode electrode 114 can be chosen according to need. The cathode electrode 114 can be made of metal, alloy, conductive slurry, or indium tin oxide (ITO). At least a part of a bottom surface of the cathode electrode 114 is oriented to the secondary electron emission layer 120. The cathode electrode 114 defines a first opening 1140. The cathode electrode 114 can have a through hole as the first opening 1140. The cathode electrode 114 can be a number of strip-shaped structures spaced from each other. An interval between two adjacent strip-shaped structures can be defined as the first opening 1140. In one embodiment, the cathode electrode 114 is a ring-shaped aluminum layer having a through hole as the first opening 1140.

The first dielectric layer 112 is located between the cathode electrode 114 and the electron pulling electrode 118 to insulate the cathode electrode 114 and the electron pulling electrode 118. The first dielectric layer 112 can be made of resin, glass, ceramic, oxide, photosensitive emulsion, or combination thereof. The oxide can be silicon dioxide, aluminum oxide, or bismuth oxide. The size, shape and thickness of the first dielectric layer 112 can be chosen according to need. The first dielectric layer 112 can be located on the insulative substrate 110 on the electron pulling electrode 118, or on the secondary electron emission layer 120. The first dielectric layer 112 defines a second opening 1120 to expose the secondary electron emission layer 120. The first dielectric layer 112 can have a through hole as the second opening 1120. The first dielectric layer 112 can include a number of strip-shaped structures spaced from each other. An interval between two adjacent strip-shaped structures can be defined as the second opening 1120. At least part of the cathode electrode 114 is located on the first dielectric layer 112. At least part of the cathode electrode 114 is oriented to the secondary electron emission layer 120 through the second opening 1120. The first opening 1140 and the second opening 1120 have at least one part overlapped. The first opening 1140 can also be smaller than the second opening 1120. In one embodiment, the first dielectric layer 112 is a ring-shaped SU-8 photosensitive emulsion with a thickness of about 100 micrometers.

The second dielectric layer 121 can be made of the same material as the first dielectric layer 112. The second dielectric layer 121 insulates the gate electrode 122 and the cathode electrode 114. The shape and size of the second dielectric layer 121 can be substantially the same as the shape and size of the cathode electrode 114. The gate electrode 122 and the cathode electrode 114 are located on two opposite surfaces of the second dielectric layer 121. The second dielectric layer 121 has a third opening 1212 which communicates with and aligns with the first opening 1140. The first opening 1140, the second opening 1120, and the third opening 1212 partially overlap at one part to define the electron output portion 1150. The second dielectric layer 121 can have a through hole as the third opening 1212. The second dielectric layer 121 can include a number of strip-shaped structures spaced from each other. An interval between two adjacent strip-shaped structures can be defined as the third opening 1212. In one embodiment, the second dielectric layer 121 is a layer structure having a through hole as the third opening 1212.

The gate electrode 122 can be a metal mesh, metal sheet, ITO film, or conductive slurry layer. The gate electrode 122 is located on a top surface of the second dielectric layer 121 and adjacent to the third opening 1212. If the gate electrode 122 is a metal mesh, the metal mesh can cover the third opening 1212. In one embodiment, the gate electrode 122 is a metal mesh and covers the third opening 1212. Furthermore, the metal mesh can be coated with a secondary electron emission material (not labeled) so that the field emission device 100 has a greater emission current. The gate electrode 122 is an optional element. When the field emission device 100 is applied to a diode FEDs, the field emission device 100 can have no gate electrode.

The electron emission layer 116 is located on the bottom surface of the cathode electrode 114 and oriented to the secondary electron emission layer 120. The electron emission layer 116 can include a number of electron emitters 1162 such as carbon nanotubes, carbon nanofibres, or silicon nanowires. Each of the electron emitters 1162 has an electron emission tip 1164. The electron emission tip 1164 points to the secondary electron emission layer 120. The size, shape, and thickness of the electron emission layer 116 can be chosen according to need. Furthermore, the electron emission layer 116 can be coated with a protective layer (not shown). The protective layer can be made of anti-ion bombardment materials such as zirconium carbide, hafnium carbide, and lanthanum hexaborid. The protective layer can be coated on a surface of each of the electron emitters 1162. In one embodiment, the electron emission layer 116 is ring-shaped with an outer diameter less than or equal to a diameter of the secondary electron emission layer 120 and an inner diameter greater than or equal to a diameter of the first opening 1140. The electron emission layer 116 can consist of a number of carbon nanotubes electrically connected to the cathode electrode 114 and a glass layer fixing the carbon nanotubes on the cathode electrode 114. The electron emission layer 116 is formed by heating a carbon nanotube slurry layer consisting of carbon nanotubes, glass powder, and organic carrier. The organic carrier is volatilized during the heating process. The glass powder is melted and solidified to form a glass layer to fix the carbon nanotubes on the cathode electrode 114 during the heating and cooling process.

The distance between the electron emission tip 1164 and the secondary electron emission layer 120 is less than a mean free path of gas molecules and free electrons. Thus, the electrons emitted from the electron emission layer 120 will bombard the secondary electron emission layer 120 before colliding with the gas molecules between the electron emission tip 1164 and the secondary electron emission layer 120. The likelihood of the electrons colliding with the gas molecules decreases, namely the likelihood of ionizing the gas molecules decreases. Thus, the electron emission tip 1164 is less likely to be bombarded by ions.

The mean free path '$\bar{\lambda}$' of the gas molecules satisfies the formula (1) as follows. The mean free path '$\bar{\lambda}_e$' of the gas molecules and free electrons satisfies the formula (2) as follows.

$$\bar{\lambda} = \frac{kT}{\sqrt{2}\pi d^2 P} \quad (1)$$

$$\bar{\lambda}_e = \frac{kT}{\pi\left(\frac{d}{2}\right)^2 P} = 4\sqrt{2}\,\bar{\lambda} \quad (2)$$

wherein 'k' is the Boltzmann constant and $k=1.38\times10^{-23}$ J/K, 'T' is the absolute temperature, 'd' is the effective diameter of gas molecules, and 'P' is the gas pressure. If the gas is nitrogen, the absolute temperature 'T' is 300K, the gas pressure 'P' is 1 Torr, the mean free path '$\bar{\lambda}$' of the gas molecules is about 50 micrometers, the mean free path '$\bar{\lambda}_e$' of the gas molecules and free electrons is about 283 micrometers. The field emission device 100 can work in a vacuum or inert gas without being damaged. In one embodiment, the distance between the electron emission tip 1164 and the secondary electron emission layer 120 can range from about 10 micrometers to about 30 micrometers. The gas pressure 'P' can range from about 9 Torrs to about 27 Torrs.

In use, a voltage supplied to the electron pulling electrode 118 is higher than a voltage supplied to the cathode electrode 114, and a voltage supplied to the gate electrode 122 is higher than the voltage supplied to the electron pulling electrode 118. In one embodiment, the voltage of the cathode electrode 114 is kept in zero by connecting to the ground, the voltage of the electron pulling electrode 118 is about 100 volts, and the voltage of the gate electrode 122 is about 500 volts. The electron emitters 1162 will emit a number of electrons under the electric field force of the electron pulling electrode 118. The electrons arrive at and bombard the secondary electron emission layer 120 so that the secondary electron emission layer 120 emits a number of secondary electrons. The secondary electrons exit though the electron output portion 1150 under the electric field force of the gate electrode 122.

The field emission device 100 has following advantages. First, the electron emission tips 1164 of the electron emitters 1162 are not exposed from the electron output portion 1150 and fail to point to the gate electrode 122. When the ions in the vacuum move toward the electron pulling electrode 118, the ions will not bombard the electron emission tips 1164. Thus, the electron emitters 1162 have a long lifespan. Second, the electrons emitted from the electron emitters 1162 bombard the secondary electron emission layer 120 producing more electrons, allowing the field emission device 100 to have a greater emission current. Third, the protective layer coated on the electron emission layer 116 can improve the stability and the lifespan of the electron emitters 1162.

Figure 4:
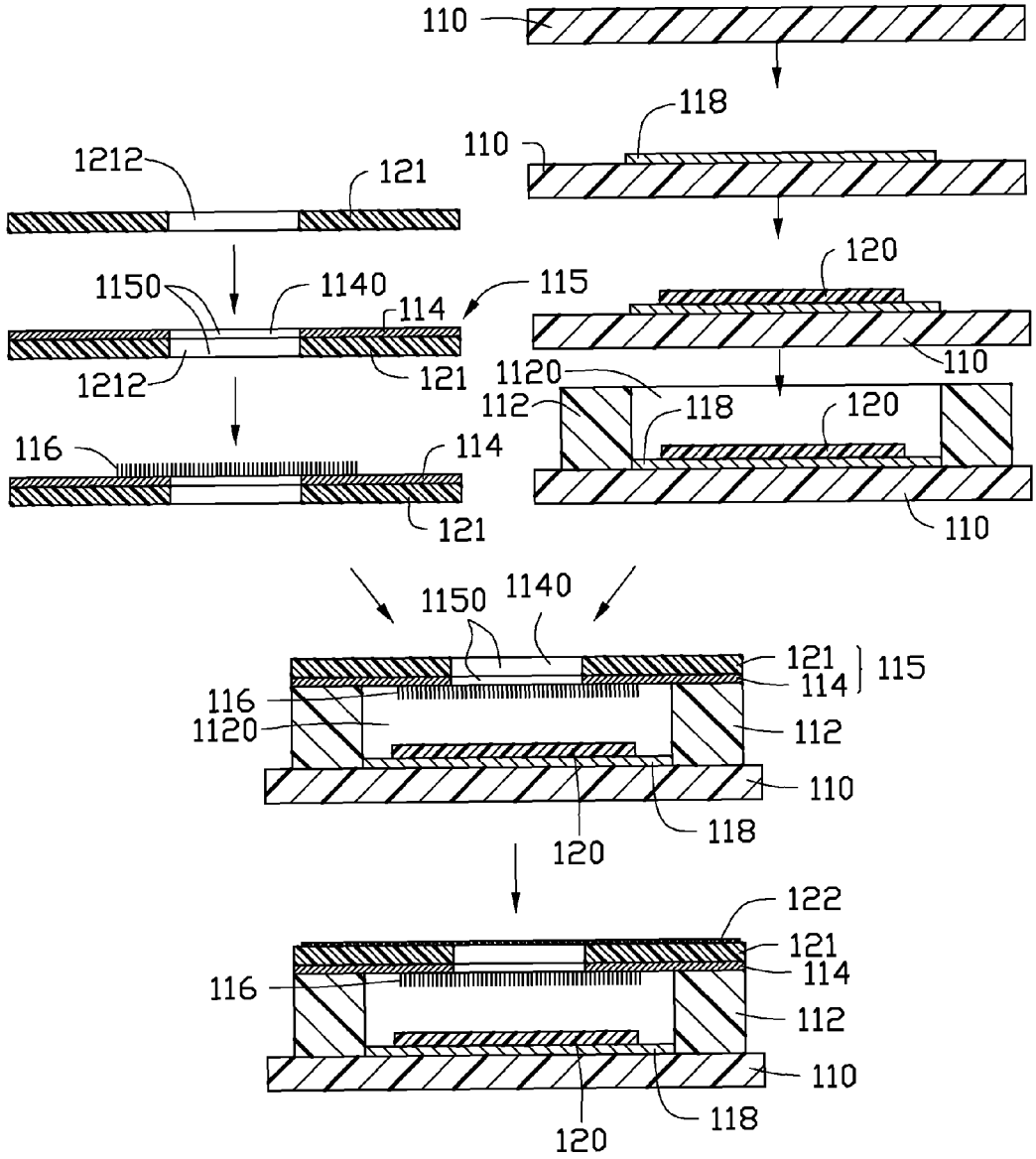
FIG. 4 shows a process of one embodiment of a method for making the field emission device of FIG. 1.

Referring to FIG. 4, a method for making a field emission device 100 of one embodiment includes the following steps:

step (a), providing an insulative substrate 110;

step (b), forming an electron pulling electrode 118 on a top surface of the insulative substrate 110;

step (c), forming a secondary electron emission layer 120 on a top surface of the electron pulling electrode 118;

step (d), forming a first dielectric layer 112 having a second opening 1120 to expose a top surface of the secondary electron emission layer 120;

step (e), supplying a cathode plate 115 having an electron output portion 1150;

step (f), forming an electron emission layer 116 on a part of the surface of the cathode plate 115;

step (g), placing the cathode plate 115 on the first dielectric layer 112, wherein the electron output portion 1150 and the second opening 1120 have at least one overlapped part, and at least one part of the electron emission layer 116 is oriented to the secondary electron emission layer 120 by the second opening 1120; and step (h), forming a gate electrode 122 on the cathode plate 115.

In step (a), the insulative substrate 110 can be made of insulative material. In one embodiment, the insulative substrate 110 is a square glass plate with a thickness of about 1 millimeter and an edge length of about 10 millimeters.

In step (b), the electron pulling electrode 118 can be formed by a method of screen printing, electroplating, chemical vapor deposition (CVD), magnetron sputtering, or heat deposition. In one embodiment, a round aluminum film is deposited on the insulative substrate 110 by magnetron sputtering.

In step (c), the secondary electron emission layer 120 can be formed by a method of screen printing, electroplating, CVD, magnetron sputtering, coating, or heat deposition. In one embodiment, a BaO film is formed on the electron pulling electrode 118 by coating.

In step (d), the first dielectric layer 112 can be formed by a method of screen printing, spin coating, or thick-film technology. The first dielectric layer 112 can be formed on the insulative substrate 110, on the electron pulling electrode 118, or on the second opening 1120. In one embodiment, the first dielectric layer 112 having a round through hole is formed on the insulative substrate 110 by screen printing.

In step (e), the cathode plate 115 can be a self supporting structure such as a conductive plate or an insulative plate having a conductive layer thereon. The cathode plate 115 can be a layer structure or include a number of strip-shaped structures. In one embodiment, the cathode plate 115 is a layer structure including a second dielectric layer 121 and a cathode electrode 114. The cathode plate 115 is made by the following steps:

step (e1), providing an insulative plate as a second dielectric layer 121, wherein the second dielectric layer 121 has a third opening 1212;

step (e2), forming a conductive layer on a surface of the second dielectric layer 121 as the cathode electrode 114, wherein the cathode electrode 114 has a first opening 1140.

In step (e1), the second dielectric layer 121 can have a through hole as the third opening 1212 or include a number of strip-shaped structures spaced from each other to define the third opening 1212. In one embodiment, the second dielectric layer 121 is a ring-shaped glass plate having a through hole as the third opening 1212.

In step (e2), the conductive layer can be formed by a method of screen printing, electroplating, CVD, magnetron sputtering, spin coating, or heat deposition. In one embodiment, a ring-shaped aluminum layer is deposited on the second dielectric layer 121 by magnetron sputtering.

In step (f), the electron emission layer 116 can be formed by screen printing a slurry or CVD growth. In one embodiment, the electron emission layer 116 is made by the following steps:

step (f1), applying a carbon nanotube slurry layer on the cathode electrode 114;

step (f2), drying the carbon nanotube slurry layer in a temperature of about 300° C. to about 400° C.;

step (f3), baking the carbon nanotube slurry layer in a temperature of about 400° C. to about 600° C.;

step (f4), cooling the carbon nanotube slurry layer to form the electron emission layer 116.

In step (f1), the carbon nanotube slurry can be applied by screen printing. The carbon nanotube slurry consists of carbon nanotubes, glass powder, and organic carrier. Namely, the carbon nanotube slurry is a mixture including carbon nanotubes, glass powder, and organic carrier, and does not include any indium tin oxide particles or other conductive particles, such as metal particles. In one embodiment, the carbon nanotubes are multi-walled carbon nanotubes with a diameter less than or equal to 10 nanometers and a length in a range from about 5 micrometers to about 15 micrometers. The glass powder is a low melting point glass powder with an effective diameter less than or equal to 10 micrometers. The organic carrier includes terpineol, ethyl cellulose, and dibutyl sebacate. The weight ratio of the terpineol, ethyl cellulose, and dibutyl sebacate is about 180:11:10.

In a related case, the indium tin oxide particles are configured to enhance the conductivity of the carbon nanotube slurry so that the electron emission layer can have a low work voltage. However, after removing the indium tin oxide particles, it was discovered that the work voltage of the electron emission layer does not increase, but decreases. After removing the indium tin oxide particles, the electric field caused by the indium tin oxide particles disappears and the electric field distribution on the surface of the electron emission layer is changed. The work voltage decrease may be a result from the change of the electric field distribution on the surface of the electron emission layer. The field emission device having an electron emission layer without indium tin oxide particles has the following advantages. First, when the field emission device is applied to the field emission display, no indium tin oxide particles would be falling off from the electron emission layer onto the gate electrode. Thus, abnormal luminescence can be avoided. Second, the field emission device without indium tin oxide particles has low cost.

In step (f2), the organic carrier is volatilized. In one embodiment, the carbon nanotube slurry layer is kept in a vacuum at about 350° C. for about 20 minutes.

In step (f3), the glass powder is melted. In one embodiment, the carbon nanotube slurry layer is kept in a vacuum at about 430° C. for about 30 minutes.

In step (f4), the melted glass powder concretes and forms a glass layer to fix the carbon nanotubes on the cathode electrode 114.

Furthermore, an optional step (f5) of surface treating can be performed after step (f4). The method of surface treating can be surface polishing, plasma etching, laser etching, or adhesive tape peeling. In one embodiment, the surface of the electron emission layer 116 is treated by adhesive tape to peel part of the carbon nanotubes not firmly attached on the electron emission layer. The remaining carbon nanotubes are firmly attached on the electron emission layer, substantially vertical and dispersed uniformly. Therefore, interference from the electric fields between the carbon nanotubes is reduced and the field emission performances of the electron emission layer 116 are enhanced.

Furthermore, an optional step (f6) of coating a protective layer can be performed after step (f5). The protective layer can be made of anti-ion bombardment materials such as zirconium carbide, hafnium carbide, and lanthanum hexaborid. In one embodiment, the protective layer is coated on a surface of each exposed carbon nanotube.

In step (g), the electron output portion 1150 and the second opening 1120 have at least one part overlapped. In one embodiment, the cathode plate 115 is placed on the first dielectric layer 112 directly with the whole electron output portion 1150 in the second opening 1120. If the cathode plate 115 includes a number of strip-shaped structures, the number of strip-shaped structures can be placed on the first dielectric layer 112 and are arranged substantially parallel with each other.

In step (h), the gate electrode 122 can be formed by a method of screen printing, electroplating, CVD, magnetron sputtering, coating, heat deposition, or placing a metal mesh directly. If the cathode plate 115 is a conductive plate, a dielectric layer needs to be placed between the cathode plate 115 and the gate electrode 122. In one embodiment, a metal mesh is placed on the second dielectric layer 121 directly as a gate electrode 122. Step (g) is an optional step.

Figure 5:
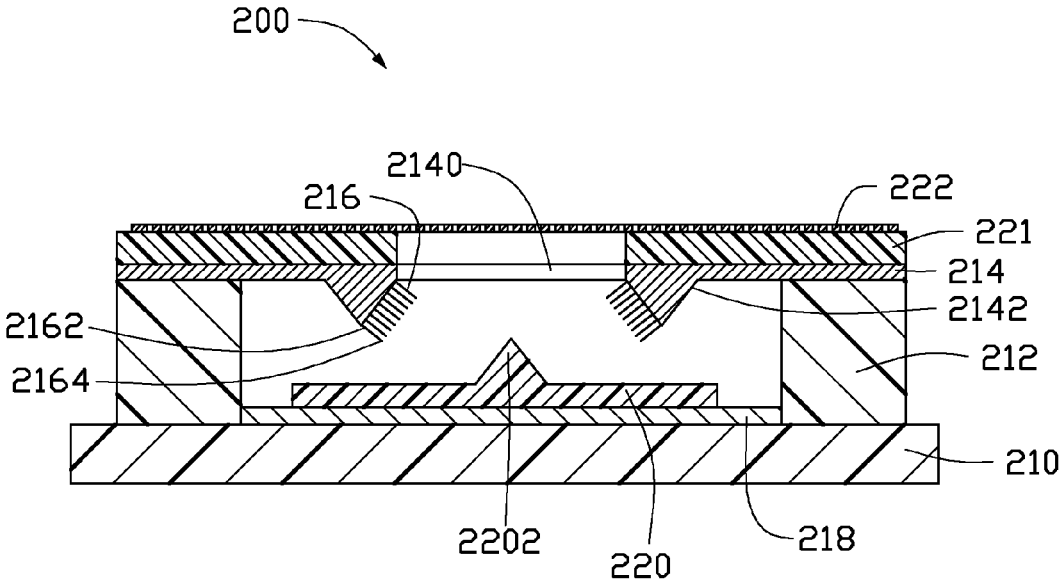
FIG. 5 is a schematic view of one embodiment of a field emission device.

Referring to FIG. 5, a field emission device 200 of one embodiment includes an insulative substrate 210, a first dielectric layer 212, a cathode electrode 214, an electron emission layer 216, an electron pulling electrode 218, a secondary electron emission layer 220, a second dielectric layer 221, and a gate electrode 222. The field emission device 200 is similar to the field emission device 100 described above except that a first bulge 2202 is located on a top surface of the secondary electron emission layer 220, and a second bulge 2142 is located on a bottom surface of the cathode electrode 214. In one embodiment, the first bulge 2202 is oriented to and exposed through a first opening 2140 of the cathode electrode 214. The electron emission layer 216 is located on a surface of the second bulge 2142 and oriented to the first bulge 2202. The electron emission layer 216 includes a number of electron emitters 2162. The number of electron emitters 2162 points to a surface of the first bulge 2202.

The shape and size of the first bulge 2202 and the second bulge 2142 can be selected according to need. If the cathode electrode 214 is a layer structure having a round through hole as the first opening 2140, the first bulge 2202 can be a taper, and the second bulge 2142 can be a ring-shape protuberance. If the cathode electrode 214 includes a number of strip-shaped structures spaced from each other, the first bulge 2202 and the second bulge 2142 can be a pyramid along the length of the strip-shaped structures. In one embodiment, the first bulge 2202 is a cone. The second bulge 2142 has a surface substantially parallel with the surface of the first bulge 2202. Each of the of electron emitters 2162 is vertical to the surface of the first bulge 2202. The secondary electron emission layer 220 can emit more secondary electrons.

Figure 6:
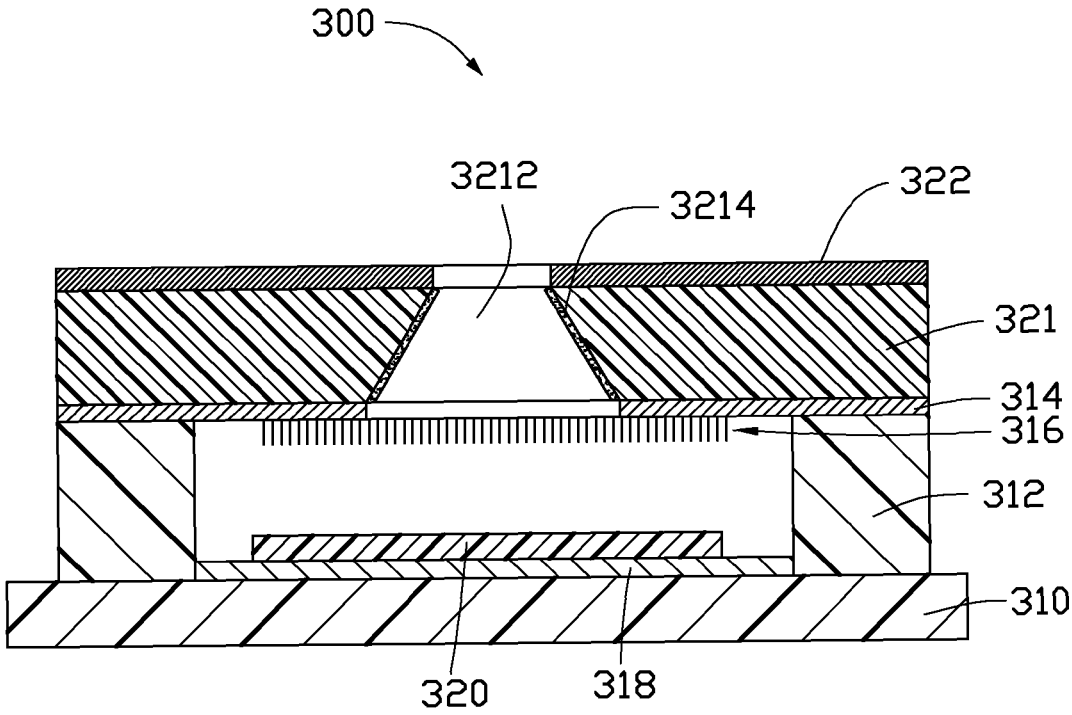
FIG. 6 is a schematic view of one embodiment of a field emission device.

Referring to FIG. 6, a field emission device 300 of one embodiment includes an insulative substrate 310, a first dielectric layer 312, a cathode electrode 314, an electron emission layer 316, an electron pulling electrode 318, a secondary electron emission layer 320, a second dielectric layer 321, and a gate electrode 322. The field emission device 300 is similar to the field emission device 100 described above except that an inner surface of the third opening 3212 is coated with secondary electron emission material 3214. The thickness of the second dielectric layer 321 is greater than about 500 micrometers. Furthermore, a number of concave-convex structures can be formed on the inner surface of the third opening 3212 so that the secondary electron emission material 3214 has a larger area. The thickness of the secondary electron emission material 3214 can be chosen according to need. In one embodiment, a size of the third opening 3212 gradually decreases along a direction apart from the secondary electron emission layer 320 so that the secondary electron emission material 3214 can easily bombard the outputted electron emissions. The thickness of the second dielectric layer 321 is in a range from about 500 micrometers to about 2000 micrometers. The gate electrode 322 is a ring-shape conductive layer and can focus the outputted electron emissions to form a beam.

Figure 7:
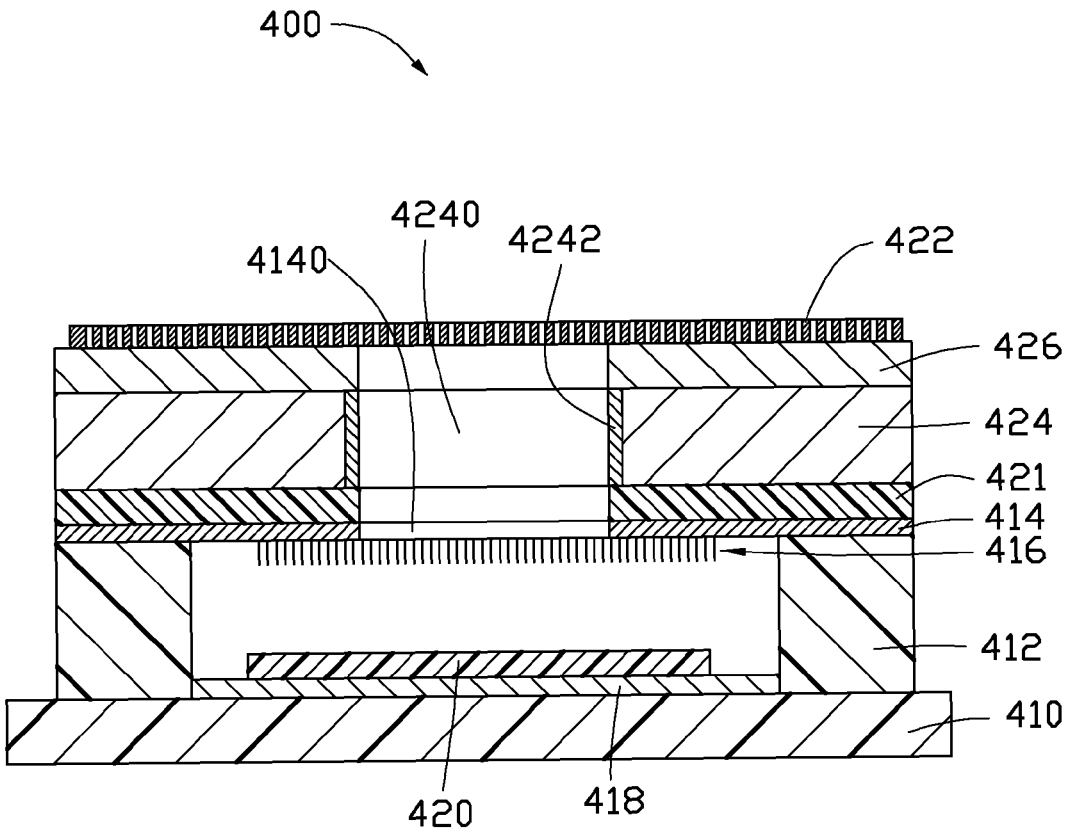
FIG. 7 is a schematic view of one embodiment of a field emission device.

Referring to FIG. 7, a field emission device 400 of one embodiment includes an insulative substrate 410, a first dielectric layer 412, a cathode electrode 414, an electron emission layer 416, an electron pulling electrode 418, a secondary electron emission layer 420, a second dielectric layer 421, a secondary electron enhancing electrode 424, a third dielectric layer 426, and a gate electrode 422. The field emission device 400 is similar to the field emission device 100 described above except that the field emission device 400 further includes a secondary electron enhancing electrode 424 and a third dielectric layer 426. The secondary electron enhancing electrode 424 has a fourth opening 4240 in alignment with a first opening 4140 of the cathode electrode 414. An inner surface of the fourth opening 4240 is coated with a secondary electron emission material 4242. The inner surface of the fourth opening 4240 can be a curved surface or have concave-convex structure so that the secondary electron emission material 4242 has a greater area.

The secondary electron enhancing electrode 424 and the third dielectric layer 426 are located between the second dielectric layer 421 and the gate electrode 422. The third dielectric layer 426 is located between the secondary electron enhancing electrode 424 and the gate electrode 422. The gate electrode 422 is a metal mesh. The secondary electron enhancing electrode 424 is a conductive layer having a thickness greater than 500 micrometers. In one embodiment, the thickness of the secondary electron enhancing electrode 424 can range from about 500 micrometers to about 2000 micrometers.

In use, a voltage supplied to the electron pulling electrode 418 is higher than a voltage supplied to the cathode electrode 414. A voltage supplied to the secondary electron enhancing electrode 424 is higher than the voltage of the electron pulling electrode 418. In addition, a voltage supplied to the gate electrode 422 is higher than the voltage of the secondary electron enhancing electrode 424. The output electrons can forcefully bombard the secondary electron emission material 4242 under the electric field force of the secondary electron enhancing electrode 424, and produce more secondary electron emissions.

Figure 8:
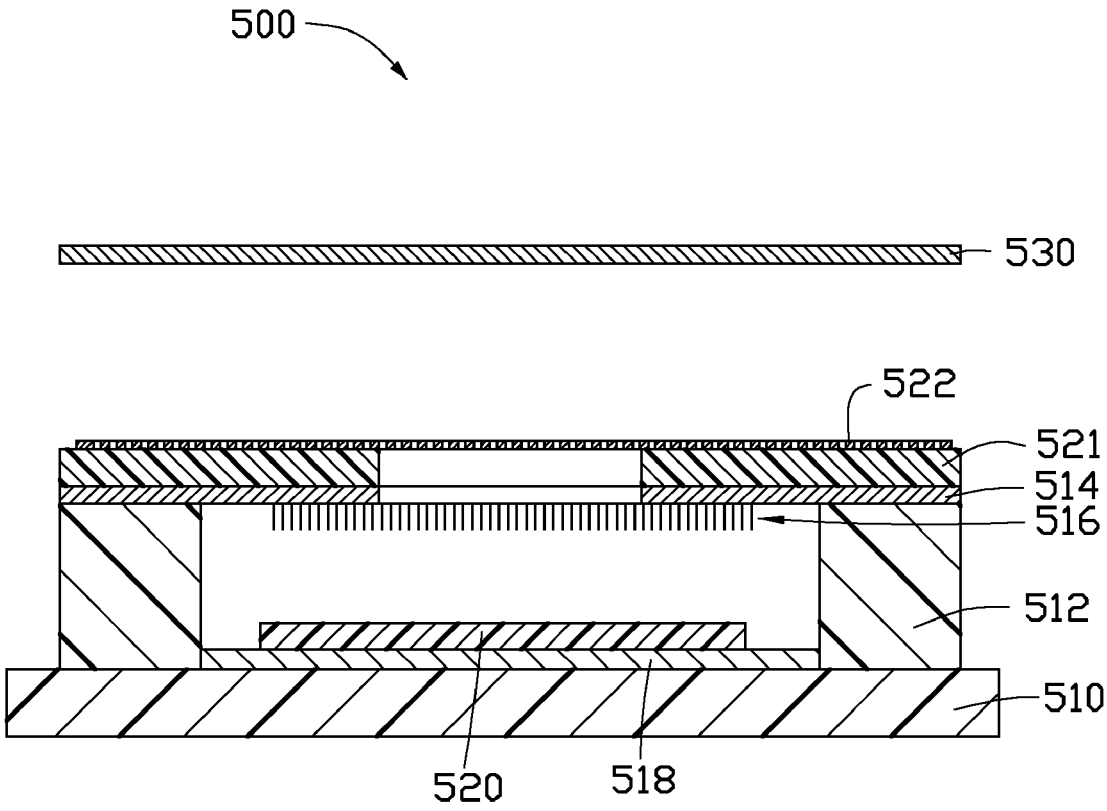
FIG. 8 is a schematic view of one embodiment of a field emission device.

Referring to FIG. 8, a field emission device 500 of one embodiment includes an insulative substrate 510, a first dielectric layer 512, a cathode electrode 514, an electron emission layer 516, an electron pulling electrode 518, a secondary electron emission layer 520, a second dielectric layer 521, a gate electrode 522, and an anode 530. The field emission device 500 is similar to the field emission device 100 described above except an anode 530 is located above the cathode electrode 514. The cathode electrode 514 is located between the anode 530 and the electron pulling electrode 518. The anode 530 is a conductive layer and can be made of metal, alloy, carbon nanotubes, or indium tin oxide (ITO). In one embodiment, the anode 530 is an ITO layer. In use, a voltage supplied to the electron pulling electrode 518 is higher than a voltage supplied to the cathode electrode 514, a voltage supplied to the gate electrode 522 is higher than the voltage of the electron pulling electrode 518, and a voltage supplied to the anode 530 is higher than the voltage of the gate electrode 522.

Figure 9:
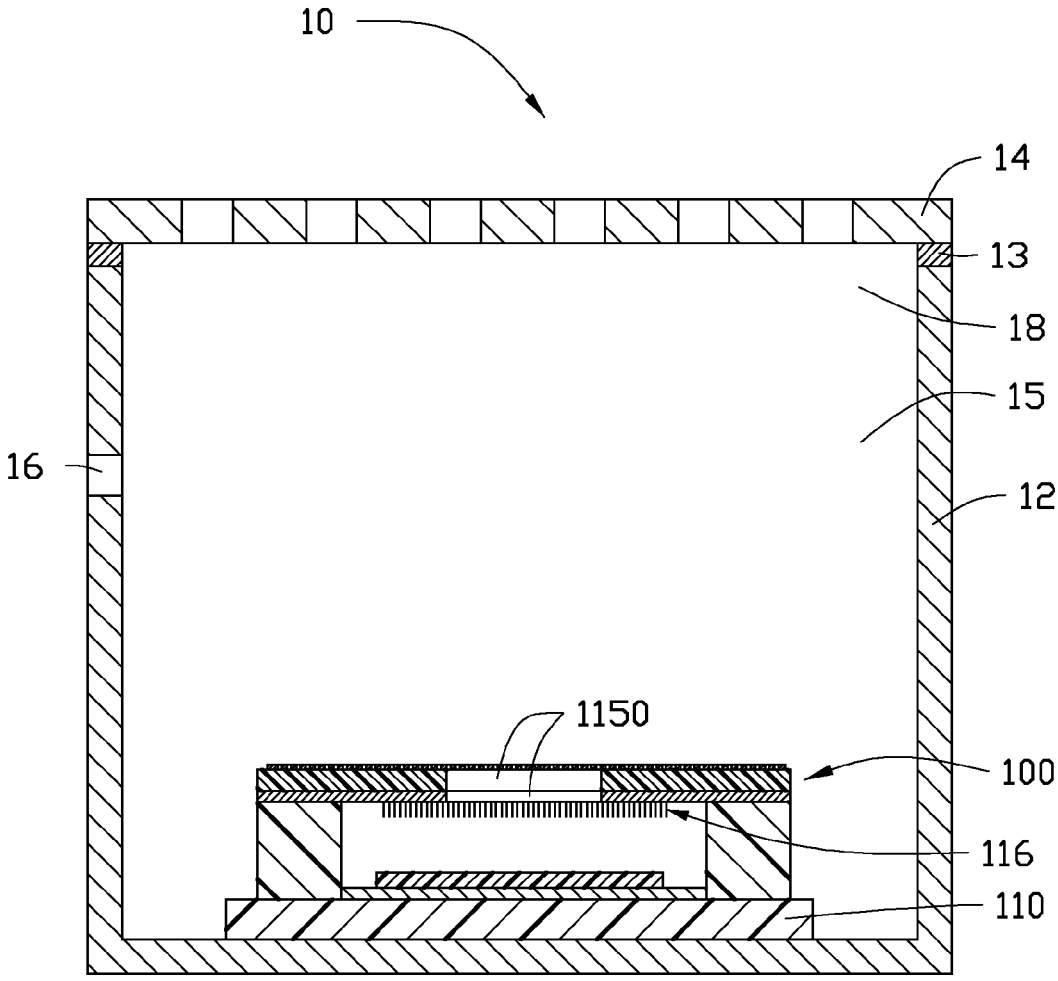
FIG. 9 is a schematic view of one embodiment of an ion source using the field emission device of FIG. 1.

Referring to FIG. 9, an ion source 10 using the field emission device 100 of one embodiment is provided and includes a shell 12, a field emission device 100, and an ion electrode 14.

The shell 12 defines an ionization chamber 15 and has a gas inlet 16 and an ion output hole 18. The field emission device 100 is located in the ionization chamber 15 and fixed on a wall of the shell 12. The electron emission layer 116 is located between the ion output hole 18 and the insulative substrate 110 so that the electron output portion 1150 is oriented to the ion output hole 18. The ion electrode 14 is located adjacent to the ion output hole 18 and insulated from the shell 12 through an insulative element 13. The field emission device 200, 300, and 400 described above can replace the field emission device 100.

The shell 12 can be made of insulative material, conductive material, or semiconductor material. If the shell 12 is made of insulative material or semiconductor material, the inner surface of the shell 12 should be coated with a conductive layer. In one embodiment, the shell 12 is a cubic metal box with a side length of about 15 millimeters.

The gas inlet 16 is formed on a side wall of the shell 12 and inputs working gas such as argon gas, hydrogen gas, helium gas, xenon gas, or mixture thereof. A size and shape of the gas inlet 16 can be selected according to need.

The ion output hole 18 can be formed on a wall of the shell 12. A size and shape of the ion output hole 18 can be selected according to need. In one embodiment, one side of the shell 12 is open and used as the ion output hole 18. The ion electrode 14 is a metal mesh and covers the ion output hole 18.

In use, the ion source 10 should be located in a vacuum. The electrons emitted from the field emission device 100 can be accelerated by the gate electrode 122 and enter the ionization chamber 15. The accelerated electrons bombard and ionize the working gas to produce ions. The ions exit the ionization chamber 15 through the ion output hole 18 under the electric field force of the ion electrode 14.

Figure 10:
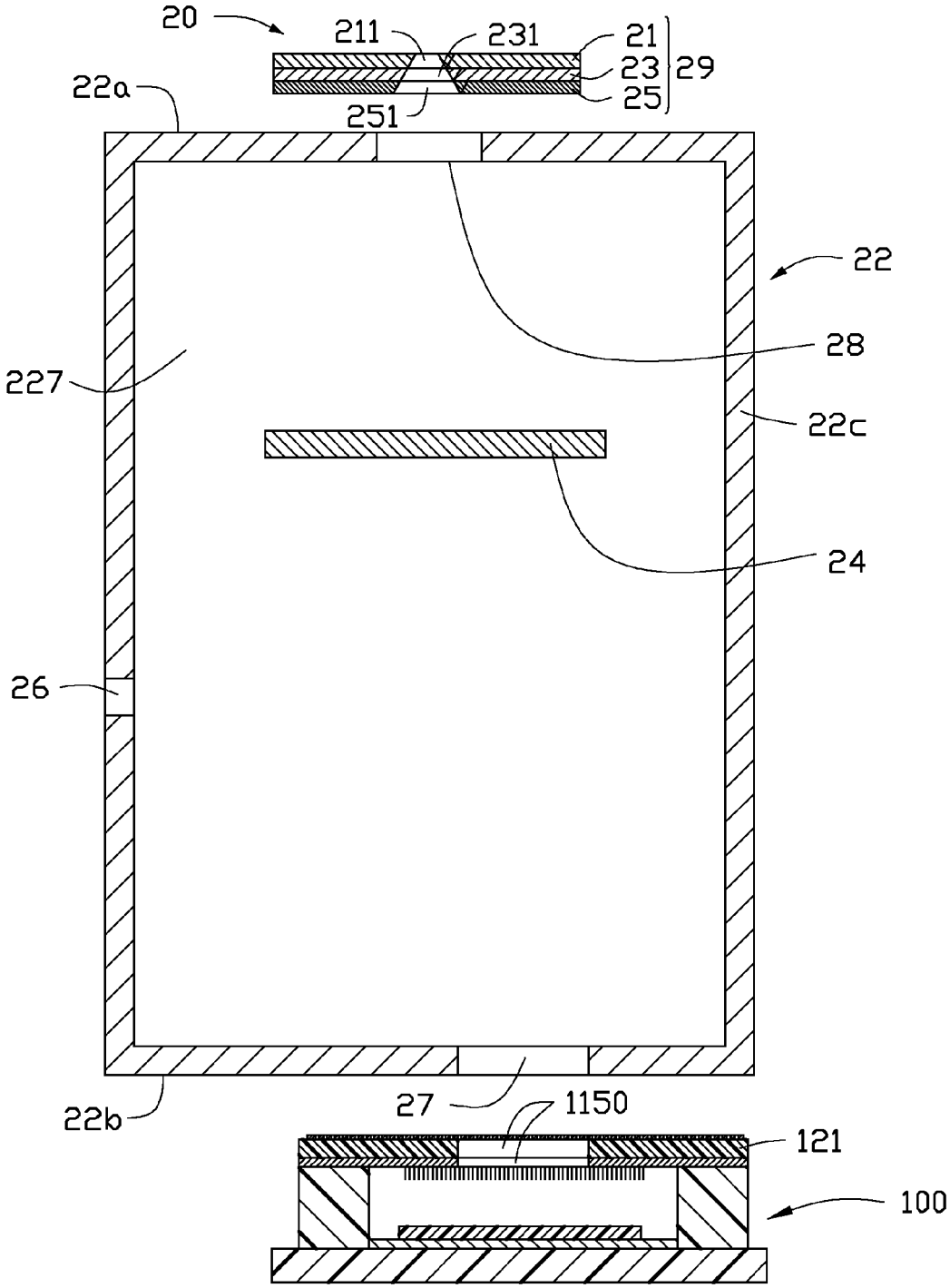
FIG. 10 is a schematic view of one embodiment of an ion source using the field emission device of FIG. 1.

Referring to FIG. 10, an ion source 20 using the field emission device 100 of one embodiment is provided and includes a shell 22, an anode electrode 24, and a field emission device 100.

The shell 22 defines an ionization chamber 227 and has a gas inlet 26, an electron input hole 27, and an ion output hole 28. The anode electrode 24 is located in the ionization chamber 227. The field emission device 100 is located outside the shell 22 and adjacent to the electron input hole 27. The electron output portion 1150 is oriented to the electron input hole 27 so that the electrons emitted from the field emission device 100 can enter the ionization chamber 227. The field emission device 200, 300, and 400 described above can replace the field emission device 100.

The shell 22 is a cylindrical structure and can be made of metal such as molybdenum, steel, or titanium. The shell 22 includes a first end 22*a*, an opposite second end 22*b*, and a main body 22*c* therebetween. The length and diameter of the shell 22 can be selected according to need. The length of the shell 22 can be about twice the diameter of the shell 22 so that the ion source 20 forms an ion gun. In one embodiment, the length of the shell 22 is about 36 millimeters, and the diameter of the shell 22 is about 18 millimeters.

The ion output hole 28 is defined in the first end 22*a* and can be coaxial with the main body 22*c*. The electron input hole 27 is defined in the second end 22*b* and located on the side of the central axis of the main body 22*c*. The size of the ion output hole 28 and the electron input hole 27 can be selected according to need. In one embodiment, the diameter of the ion output hole 28 is about 1 millimeter, and the diameter of the electron input hole 27 is about 4 millimeters.

The gas inlet 26 is defined in the main body 22*c* and inputs working gas such as argon gas, hydrogen gas, helium gas, xenon gas, or mixture thereof. The gas inlet 26 can be adjacent to the second end 22*b* of the shell 22 so that the working gas distributes more uniformly in the ionization chamber 227. The size of the gas inlet 26 can be selected according to need.

The anode electrode 24 is a metal ring, which can decrease the amount of the electrons captured by the anode electrode 24. The size of the anode electrode 24 can be selected according to need. In one embodiment, the diameter of the anode electrode 24 is about 0.2 millimeters. The anode electrode 24 is located in the middle of the main body 22*c* and coaxial with the main body 22*c*. A saddle-shaped electric field can be generated in the ionization chamber 227 when a potential difference is applied between the anode electrode 24 and the shell 22. The elections can travel a relatively long distance in the saddle electric field and then collide with the working gas to cause an ionization of the working gas and generate ions.

Furthermore, the ion source 20 may include an aperture lens 29 formed on or above an outer surface of the first end 22*a* of the shell 22. The aperture lens 29 focuses the ions exiting from the ion output hole 28. The aperture lens 29 includes a first electrode 21, a second electrode 23, and a third electrode 25. The first electrode 21 defines a first through hole 211, the second electrode 23 defines a second through hole 231, and the third electrode 25 defines a third through hole 251. The first electrode 21, the second electrode 23, and the third electrode 25 overlap. The first through hole 211, the second through hole 231, and the third through hole 251 are coaxial with the ion output hole 28. The size of the ion output hole 28, the third through hole 251, the second through hole 231, and the first through hole 211 become smaller in sequence.

In use, the cathode electrode 114 of the field emission device 100 is electrically connected to the shell 22, and the shell 22 is electrically connected to ground. The electrons emitted from the field emission device 100 enter the ionization chamber 227 and oscillate multiple times in the electrostatic field in the ionization chamber 227. The electrons bombard and ionize the working gas to produce ions. The ions exit the ionization chamber 227 through the ion output hole 28 and are focused by the aperture lens 29 to form an ion beam.

Figure 11:
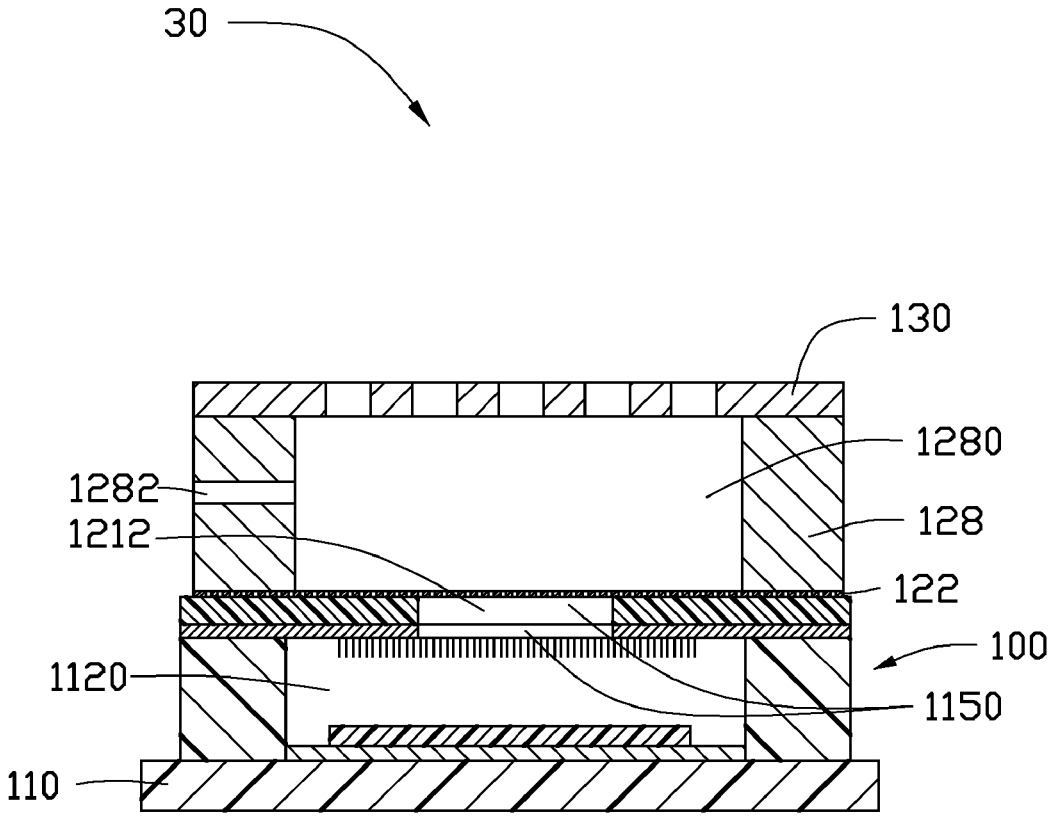
FIG. 11 is a schematic view of one embodiment of an ion source using the field emission device of FIG. 1.

Referring to FIG. 11, an ion source 30 using the field emission device 100 of one embodiment is provided and includes a field emission device 100, a fourth dielectric layer 128, and an ion electrode 130.

The fourth dielectric layer 128 is located on a surface of the gate electrode 122. The fourth dielectric layer 128 has a fifth opening 1280 corresponding to the electron output portion 1150 of the field emission device 100 and defines an ionization chamber. The area of the fifth opening 1280 is greater than the area of the third opening 1212. In one embodiment, the area of the fifth opening 1280 is substantially the same as the area of the second opening 1120. A gas inlet 1282 is formed on the wall of the fourth dielectric layer 128 and inputs working gas. The ion electrode 130 is located on the fourth dielectric layer 128. The ion electrode 130 is a metal mesh and covers the fifth opening 1280. The field emission device 200, 300, 400 described above can replace the field emission device 100.

In use, the ion source 30 should be located in a vacuum. A negative voltage should be supplied to the ion electrode 130. The electrons emitted from the field emission device 100 can enter the ionization chamber defined by the fifth opening 1280. The electrons bombard and ionize the working gas to produce ions. The ions exit the ionization chamber under the electric field force of the ion electrode 130.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A method for making a field emission device, comprising:

providing an insulative substrate;

forming an electron pulling electrode on the insulative substrate;

forming a secondary electron emission layer on the electron pulling electrode;

fabricating a first dielectric layer, wherein the first dielectric layer has a second opening to expose the secondary electron emission layer;

supplying a cathode plate having an electron output portion;

forming an electron emission layer on a part of a surface of the cathode plate, wherein the electron emission layer is made by:

applying a carbon nanotube slurry layer on the cathode electrode;

drying the carbon nanotube slurry layer in a temperature of about 300° C. to about 400° C.;

baking the carbon nanotube slurry layer in a temperature of about 400° C. to about 600° C.;

cooling the carbon nanotube slurry layer; and coating a protective layer made of anti-ion bombardment materials selected from the group consisting of zirconium carbide, hafnium carbide, lanthanum hexaborid, and combinations thereof, after cooling the carbon nanotube slurry; and placing the cathode plate on the first dielectric layer, wherein the electron output portion and the second opening have at least one part overlapped, and at least one part of the electron emission layer is oriented to the secondary electron emission layer via the second opening.

2. The method of claim 1, wherein the electron pulling electrode and the secondary electron emission layer are formed by a method of screen printing, electroplating, chemical vapor deposition, magnetron sputtering, or heat deposition.

3. The method of claim 1, wherein the first dielectric layer is formed by a method of screen printing, spin coating, or thick-film technology.

4. The method of claim 1, wherein the cathode plate is made by:

providing an insulative plate as a second dielectric layer, wherein the second dielectric layer has a third opening; and forming a conductive layer on a surface of the second dielectric layer as a cathode electrode, wherein the cathode electrode has a first opening.

5. The method of claim 4, wherein the second dielectric layer comprises a plurality of strip-shaped structures spaced from each other to define the third opening.

6. The method of claim 1, wherein the electron emission layer is formed by screen printing a slurry or chemical vapor deposition growth.

7. The method of claim 1, wherein the carbon nanotube slurry is applied by screen printing.

8. The method of claim 1, wherein the carbon nanotube slurry consists of carbon nanotubes, glass powder, and organic carrier.

9. The method of claim 8, wherein the carbon nanotubes are multi-walled carbon nanotubes with a diameter less than or equal to 10 nanometers and a length in a range from about 5 micrometers to about 15 micrometers.

10. The method of claim 8, wherein the glass powder is a low melting point glass powder with an effective diameter less than or equal to 10 micrometers.

11. The method of claim 8, wherein the organic carrier comprises terpineol, ethyl cellulose, and dibutyl sebacate.

12. The method of claim 1, further comprising a step of surface treating by surface polishing, plasma etching, laser etching, or adhesive tape peeling, after cooling the carbon nanotube slurry.

13. The method of claim 1, further comprising a step of forming a gate electrode on the cathode plate.

* * * * *